United States Patent [19]

Donenfeld et al.

[11] Patent Number: 5,015,261

[45] Date of Patent: May 14, 1991

[54] PRE-TREATMENT OF CELLULOSIC FIBRES OR CELLULOSIC FIBRES IN BLENDS WITH SYNTHETIC FIBRES FOR SUBSEQUENT TRANSFER PRINTING

[75] Inventors: Henry Donenfeld, Brighton; Eduard Lemanis, East Keilor, both of Australia

[73] Assignee: BASF Australia, Ltd., Melbourne, Australia

[21] Appl. No.: 63,492

[22] Filed: Jun. 16, 1987

[30] Foreign Application Priority Data

Jun. 16, 1986 [AU] Australia ..... PH06423

[51] Int. Cl.[5] ..... D06P 3/82

[52] U.S. Cl. ..... 8/532; 8/496; 8/541; 8/542; 8/557; 8/566; 8/580; 8/581; 8/594; 8/611

[58] Field of Search ..... 8/532, 196, 181, 496, 8/541, 566

[56] References Cited

U.S. PATENT DOCUMENTS 4,210,412 7/1980 Yamane et al. ..... 8/471
4,310,426 1/1982 Smeltz ..... 252/8.8

*Primary Examiner*—Prince E. Willis
*Assistant Examiner*—John F. McNally
*Attorney, Agent, or Firm*—Irell & Manella

[57] ABSTRACT

A process for the pre-treatment of natural and regenerated cellulosic fibres and blends thereof with synthetic fibres for the purpose of subsequent transfer printing comprises applying to said fibres a composition comprising a mixture of hexamethoxymethyl melamine and a $C_{4-8}$ glycol in the presence of water, and drying said fibres at a temperature below 180° C.

The above compositions per se, with or without water and polyvinyl chloride or polyvinylidene chloride polymer or copolymer emulsions or dispersions, are also claimed.

19 Claims, No Drawings

PRE-TREATMENT OF CELLULOSIC FIBRES OR CELLULOSIC FIBRES IN BLENDS WITH SYNTHETIC FIBRES FOR SUBSEQUENT TRANSFER PRINTING

This invention relates to the pre-treatment of natural and regenerated cellulosic fibres and blends thereof with synthetic fibres for the purpose of subsequent transfer printing.

Various pre-treatments have been proposed in the past to enable cellulosic fibres or cellulosic fibres in blends with synthetic fibres to be transfer printed. These pre-treatments produced either a poor colour yield with acceptable fastness properties, or an acceptable colour yield with acceptable fastness properties but a stiff unacceptable handle of the fabric. Nor was the amount of free formaldehyde acceptable. Apart from these drawbacks, the whole process was critical from the point of view of tensions on the fabric during drying on stenters as well as sensitivity to variations in the drying temperatures.

Accordingly, it is the object of this invention to overcome the above problems by a novel pre-treatment of the above fibres.

According to a preferred aspect of the invention there is provided a process for the pre-treatment of natural and regenerated cellulosic fibres and blends thereof with synthetic fibres for the purpose of subsequent transfer printing, comprising applying to said fibres a composition comprising a mixture of hexamethoxymethyl melamine and a $C_{4-8}$ glycol in the presence of water, and drying said fibres at a temperature below 180° C.

The preferred proportion by weight between the amount of the hexamethoxymethyl melamine and the glycol varies according to the ratio of synthetics to cellulosics in the fibre blends; for example for a ratio of 65:35 polyester/cotton fabric, the preferred ratio of these compounds is 1:1; whereas for a fibre ratio of 50:50, the ratio for the compounds is 1.5:1. However, the proportions will also depend on the properties required from the printed product.

Examples of $C_{4-8}$ glycols are 2-methyl-butane-1,4-diol; butane-1,2-diol; butane-1,3-diol; butane-1,4-diol and butane-2,3-diol; hexane-2,5-diol; pentane-1,5-diol and neopentyl glycol. Preferably, the glycols used are 2-methyl-pentane-2,4-diol; 2-methylpentane-1,5-diol; hexane-1,6-diol.

Preferably the melamine is water insoluble, or partly or sparingly soluble. As is well known, pure hexamethoxymethyl melamine is a water soluble substance. To render the melamine water insoluble, it is slightly self-condensed. The production of this condensed compound is well-known and is generally as follows:

Melamine is reacted with formaldehyde and acetylated with methanol. In the presence of acid catalysts and in the absence of other functional groups, it condenses with itself. Such a product is termed "technical" hexamethoxymethyl melamine and is commercially available. Generally, these mixtures comprise 50 to 70% by weight hexamethoxymethyl melamine and also contain its condensation products of 2 to 3 and up to 6 molecules of precondensed melamine. For instance, a typical mixture may contain about 60% by weight hexamethoxymethyl melamine, about 13% by weight of 2 to 4 molecular condensate and about 26% of the 6 molecular condensate (e.g. Luvipal 066*).

*Regd. Trade Mark of BASF AKTIENGESELLSCHAFT

The amounts of hexamethoxymethyl melamine in the composition is preferably 7.7 to 120 g/l at 75% composition pick-up by weight of fabric, or 0.5 to 9% by weight of the textile fibres treated, and the amount of glycol is preferably at least 13.3 g/l, or at least 1% by weight of the textile fibres treated. More preferably 20 g/l (or 1.5% by weight of the textile fibres treated) of each compound may be used for a 65/35 fibre blend fabric, 30 g/l and 20 g/l respectively of the melamine and glycol for a 50/50 fibre blend fabric. These figures are for a 75% composition pick-up weight of fabric. It will be appreciated that the above respective amounts of melamine and glycol are always subject to the proportions indicated in an earlier part of this specification.

Advantageously, polyvinyl chloride or polyvinylidene chloride polymer and copolymer emulsions or dispersions may be added to the composition to enhance the wet fastness properties. The latter is generally added in an amount in the range of 10 to 20 g/l at 75% composition pick-up by weight of fabric.

The soft handle of 100% cotton fabrics, pre-treated, dried and subsequently transfer printed, is enhanced further by addition of up to about 17% preferably by 10% by weight of the polyvinyl chloride polymers or copolymers used of plasticisers, such as dibutyl phthalate, sebacate esters and other plasticisers ordinarily used to plasticise polyvinyl chloride films.

The application of the composition to the fibres may be effected, for instance, by padding, spraying, coating, printing or impregnation. When pre-treatment is effected by padding, conventional techniques are used and the uptake of solids from the bath is regulated according to requirements in a manner well known to persons skilled in the art. When using spraying, an atomiser may conveniently be used spraying the fabric at the area designated for the transfer of the coloured design. This kind of pre-treatment is, of course, more economical as only the necessary surface needs to be sprayed and no padding and stentering are needed. T-shirts lend themselves very well for this kind of pre-treatment.

Tensions and temperatures during drying are not critical. Drying temperatures of up to 180° C. without any apparent detrimental effect on the pre-treatment have been observed. Naturally, limitations regarding heat stability of the fibre itself being treated must be observed.

Whereas other pre-treatments use high concentrations of crosslinking resins to achieve a more or less acceptable colour yield and fastness properties but an unacceptable stiff handle, the present invention uses a relatively small concentration of the hexamethoxymethyl melamine acting as the crosslinking resin. A highly satisfactory colour yield is obtained by the use of the glycol. Therefore, this is the criterion of the invention, namely the use of the glycol in conjunction with a small amount of hexamethoxymethyl melamine. The glycol is mainly responsible for the colour yield. The melamine is used predominantly for the crosslinking of the polyvinyl chloride and glycol. Exceptional colour yield, being similar to that obtained when transfer printing 100% polyester, can be obtained using correct transfer temperatures and dwelling times, for example, 200° C., for 30 seconds. The fastness properties are comparatively good and the fabric preserves the handle it had before being pre-treated.

According to another aspect of the invention, there is also provided a composition for the pre-treatment of natural and regenerated cellulosic fibres and blends thereof with synthetic fibres for the purpose of subsequent transfer printing, comprising a mixture of hexamethoxymethyl melamine and a $C_{4-8}$ glycol, in the presence of water, and optionally, an emulsion or dispersion of polyvinyl chloride, or polyvinylidene chloride polymers and copolymers.

According to yet a further aspect of the invention, there is provided a composition for use in a composition for the pre-treatment of natural and regenerated cellulosic fibres and blends thereof with synthetic fibres for the purpose of subsequent transfer printing, comprising a solution of hexamethoxymethyl melamine in a $C_{4-8}$ glycol. The above composition may subsequently be admixed with water and the optional polyvinyl chloride or polyvinylidene chloride polymer or copolymer emulsion or dispersion added by the end user of the product.

The following are examples of the pre-treatment bath in accordance with the present invention, it being clearly understood that the invention in its general aspect is in no way limited by the specific details of these examples.

EXAMPLE 1

20 g of water insoluble technical hexamethoxymethyl melamine (CYMEL 303*) was dissolved in 20 g of 2-methyl-butane-1,4-diol and the solution was made up to 1000 g by adding 960 g of water.

Regd. Trade Mark of AMERICAN CYANAMID COMPANY

Two fabrics consisting of 65:35 parts by weight of polyester/cotton and polyester/viscose fibres, respectively, were padded on a Benz padder at room temperature (18° C.) to a pick-up of 75 to 80% of composition by weight of fabric with the above composition and dried at 120° C. Both fabrics were then transfer printed on a transfer press at 200° C. for 30 seconds using commercially available transfer papers, presumably printed with low energy sublimation disperse dyes.

EXAMPLE 2

The same procedure and amounts as above were used but in addition 20 g of 50% solids technical grade polyvinyl chloride emulsion or dispersion was added to the padding liquor and the composition was made up to 1000 g by adding 940 g of water. padded at 75 to 80% of composition pick-up by weight of fabric and dried at 120° C. and were then ready for transfer printing, as above.

The yield, handle and wet fastness properties obtained in both Examples 1 and 2 were much better, compared to untreated fabric.

The wet fastness properties in Example 1 were comparable to previous pre-treatments, but superior in Example 2.

The handle in both Examples 1 and 2 was significantly softer compared to previously known processes.

The light fastness was comparable with most previous processes but superior to some.

EXAMPLE 3

A 65/35 polyester/cotton and a polyester/viscose woven upholstery fabric was printed and coated respectively on a Stork Rotary printing, respectively, coating machine with the following composition:

| | |
|---|---|
| 20 g | 2-methylpentane-1,5-diol |
| 20 g | Hexamethoxymethyl melamine (technical) (Luvipal 066*) |
| 40 g | Polyacrylic acid polymer (high molecular weight) (Lutexal HP*) |
| 15 g | Polyvinyl chloride (50% emulsion or dispersion) |
| 905 g | Water |
| 1000 g | |

The printing/coating speed was 35 m/minute. The fabric was then dried on a 5 bay stenter (15 meters) at 140° C.

EXAMPLE 4

A 50/50 polyester/cotton sheeting fabric (plain weave) was treated in similar fashion to the method in Example 3 with the following composition:

| | |
|---|---|
| 30 g | Hexamethoxymethyl melamine (Luvipal 066*) |
| 20 g | 2-methylpentane-1,5-diol |
| 40 g | Polyacrylic acid polymer (high molecular weight) (Lutexal HP*) |
| 15 g | Polyvinyl chloride (50% emulsion or dispersion) |
| 895 g | Water |
| 1000 g | |

EXAMPLE 5

A 65/35 polyester/cotton single knit fabric was sprayed, with a simple atomiser, with the following composition:

| | |
|---|---|
| 10 g | Hexamethoxymethyl melamine (CYMEL 303**) |
| 10 g | 2-methylpentane-2,4-diol |
| 10 g | Polyvinyl chloride (50% emulsion or dispersion) |
| 970 g | Water |
| 1000 g | |

*Regd. Trade Mark of BASF AKTIENGESELLSCHAFT
**Regd. Trade Mark of AMERICAN CYANAMID COMPANY The so-treated fabric was dried at 80° C.

EXAMPLE 6

A 65/35 polyester/cotton double knit jersey and 35 polyester/viscose single knit jersey and 65/35 polyester/viscose woven apparel fabric (twill construction 1) were impregnated at room temperature (18° C.) in a tub, with a composition consisting of:

| | |
|---|---|
| 10 g | Hexamethoxymethyl melamine |
| 10 g | Hexane-1,6-diol |
| 10 g | Polyvinyl chloride (50% emulsion or dispersion) |
| 970 g | Water |
| 1000 g | |

The above fabrics were then hydroextracted in a household washing machine to a residual moisture of 35 to and dried on a clothes line.

All examples, when transfer printed with conventional, commercially available transfer papers of unknown composition, but presumably and by definition printed with sublimeable disperse dyestuffs, gave similar good average results, with exceptional colour yield and brightness compared to untreated fabrics, and good wet fastness properties.

Against similar fabrics, pre-treated with previously known processes, similar superior results as outlined in previous Examples 1 and 2 were obtained.

EXAMPLE 7

Pre-Treatment of 100% cotton upholstery fabric

One square meter of the above fabric was pre-treated, by padding to 75% composition pick-up by weight of fabric on a Benz (Switzerland) padder with the following composition:

| | |
|---|---|
| 50 g | "Product L-90"* |
| 60 g | 2-methylpentane-2,4-diol (Hexylene glycol**) |
| 30 g | Dibutyl phthalate |
| 50 g | Latex 576*** |
| 810 g | Water |
| 1000 g | |

*Note - Preparation of Product L-90

The following compounds were mixed together by stirring with a propeller-type stirrer at 1000 rpm.

| | |
|---|---|
| 600 kgs | hexamethoxymethyl melamine (technical) (CYMOL 303) |
| 400 kgs | 2-methylpentane-2,4-diol. |

This resulted in 1000 kgs of "Product L90"*.

Drying temperatures were chosen in 20° C. intervals between 100° to 180° C. The fabrics were subsequently transfer printed with conventional transfer papers, printed by the Bafixan process of BASF AG.

EXAMPLE 8

The same procedure was carried out as in Example 7 using the following composition:

| | |
|---|---|
| 60 g | "Product L-90"* |
| 50 g | 2-methylpentane-2,4-diol (Hexylene glycol)** |
| 50 g | Latex 576*** |
| 840 g | Water |
| 1000 g | |

**Trade name and product of SHELL CHEMICALS
***Regd. Trade Mark of B. F. GOODRICH U.S.A.

In both Examples 7 and 8, the light and wash fastness obtained corresponded to commercially acceptable standards in the U.S.A., the best results being obtained at drying temperatures below 140° C.

We claim:

1. A process for the pre-treatment of natural and regenerated cellulosic fibres and blends thereof with synthetic fibres for the purpose of subsequent transfer printing, comprising applying to said fibres a composition comprising a mixture of a water insoluble technical hexamethoxymethyl melamine having 50–70 weight percent hexamethoxymethyl melamine, the remainder being the self-condensation products of hexamethoxymethyl melamine having 2 to 6 molecular condensates of hexamethoxymethyl melamine and a $C_{4-8}$ glycol in water, and drying said fibres at a temperature below 180° C.

2. A process as claimed in claim 1 wherein the $C_{4-8}$ glycol is selected from the group consisting of 2-methylbutane-1,4-diol, butane-1,2-diol, butane-1,3-diol, butane-1, 4-diol, butane-2,3-diol, hexane-2,5-diol, pentane-1,5-diol, neopentyl glycol and, preferably, 2-methylpentane-2,4-diol, 2-methylpentane-1,5-diol, and hexane-1,6-diol.

3. A process as claimed in of claim 1 wherein the composition also includes a polyvinyl chloride or polyvinylidene chloride polymer or copolymer emulsion or dispersion in an amount of 10 to 20 g/l at 75% composition pick-up by weight of fabric.

4. A process as claimed in of claim 1 wherein the proportion of the amounts by weight of hexamethoxymethyl melamine to the glycol for a 65/35 polyester/cotton fabric is about 1:1.

5. A process as claimed in claim 1 wherein the proportion of the amounts by weight of hexamethoxymethyl melamine to the glycol for a 50:50 polyester/cotton fabric is about 1.5:1.

6. A process as claimed in of claim 1 wherein the composition is applied to the fibres by padding, spraying, coating, printing or impregnation.

7. A process as claimed in claim 1 wherein the amount of hexamethoxymethyl melamine and glycol in the composition are 10 to 50 g/l at 75% composition pick-up by weight of fabric, or 0.7 to 3.7% by weight of the textile fibres treated.

8. A process as claimed in claim 7 wherein the amounts are 20 g/l at 75% composition pick-up by weight of fabric or 1.5% by weight of the textile fibres treated.

9. A composition for the pre-treatment of natural and regenerated cellulosic fibres and blends thereof with synthetic fibres for the purpose of subsequent transfer printing, comprising a mixture of a water insoluble technical hexamethoxymethyl melamine having 50–70 weight percent hexamethoxymethyl melamine, the remainder being the self-condensation products of hexamethoxymethyl melamine having 2 to 6 molecular condensates of hexamethoxymethyl melamine and a $C_{4-8}$ glycol in of water.

10. A composition of claim 8 wherein the melamine is a water insoluble technical hexamethoxymethyl melamine.

11. A composition as claimed in claim 9 which also includes a polyvinyl chloride or polyvinylidene chloride polymer or copolymer emulsion or dispersion in an amount of 10 to 20 g/l at 75% composition pick-up by weight of fabric.

12. A composition as claimed in claim 9 wherein the proportion of the amounts by weight of hexamethoxymethyl melamine to glycol for a 65:35 polyester/cotton fabric is about 1:1.

13. A composition as claimed in claim 9 wherein the proportion of the amounts by weight of hexamethoxymethyl melamine to glycol for a 50:50 polyester/cotton fabric is about 1.5:1.

14. A composition as claimed in claim 9 wherein the amounts of hexamethoxymethyl melamine and glycol in the composition are 10 to 50 g/l at 75% composition pick-up by weight of fabric, or 0.7 to 3.7% by weight of the textile fibres treated.

15. A composition as claimed in claim 14 wherein the amounts of the melamine and glycol are 20 g/l at 75% composition pick-up by weight of fabric, or 1.5% by weight of the textile fibres treated.

16. A composition for subsequent use in a composition for the pre-treatment of natural and regenerated cellulosic fibres and blends thereof with synthetic fibres for the purpose of subsequent transfer printing, comprising a mixture of a water insoluble technical hexamethoxymethyl melamine having 50-70 weight percent hexamethoxymethyl melamine, the remainder being the self-condensation products of hexamethoxymethyl melamine having 2 to 6 molecular condensates of hexamethoxymethyl melamine and a $C_{4-8}$ glycol.

17. A composition as claimed in claim 16 wherein said $C_{4-8}$ is selected from the group consisting of 2-methylbutane-1,4-diol, butane-1,2-diol, butane-1,3-diol, butane-1,4-diol, and butane-2,3-diol, hexane-2,5-diol, pentane-1,5-diol, neopentyl glycol and, preferably, 2-methylpentane-2,4-diol, 2-methylpentane-1,5-diol, and hexane-1,6-diol.

18. A composition as claimed in any one of claims 1 and 17 wherein the proportion of the amounts by weight of hexamethoxymethyl melamine to glycol for a 65:35 polyester/cotton fabric is about 1:1.

19. A composition as claimed in any one of claims 1 and 17 wherein the proportion of the amounts by weight of hexamethoxymethyl melamine to glycol for a 50:50 polyester/cotton fabric is about 1.5:1.

* * * * *